US011318335B2

(12) United States Patent
Cortazzo et al.

(10) Patent No.: US 11,318,335 B2
(45) Date of Patent: May 3, 2022

(54) AUXILIARY FIRE DEFENSE SYSTEM

(71) Applicant: FIRE PROTECTION CONSULTANTS OF CALIFORNIA LLC, Stevenson Ranch, CA (US)

(72) Inventors: Daniel Charles Vincent Cortazzo, Santa Cruz, CA (US); William James Prabhu, Ladera Ranch, CA (US); Michael Thomas Prabhu, Los Angeles, CA (US); John Charles Prabhu, Stevenson Ranch, CA (US); Anthony Landis Syracuse, Valencia, CA (US); Damon Gabriel Green, Northridge, CA (US)

(73) Assignee: FIRE PROTECTION CONSULTANTS OF CALIFORNIA LLC, Stevenson Ranch, CA (US)

( * ) Notice: Subject to any disclaimer, the term of this patent is extended or adjusted under 35 U.S.C. 154(b) by 0 days.

(21) Appl. No.: 16/818,198

(22) Filed: Mar. 13, 2020

(65) Prior Publication Data

US 2020/0289862 A1 Sep. 17, 2020

Related U.S. Application Data

(60) Provisional application No. 62/818,671, filed on Mar. 14, 2019.

(51) Int. Cl.

| | |
|---|---|
| ***A62C 25/00*** | (2006.01) |
| ***A62C 3/02*** | (2006.01) |
| ***A62C 31/28*** | (2006.01) |
| ***A62C 27/00*** | (2006.01) |

(52) U.S. Cl.
CPC ..... *A62C 25/005* (2013.01); *A62C 3/0271* (2013.01); *A62C 3/0292* (2013.01); *A62C 27/00* (2013.01); *A62C 31/28* (2013.01)

(58) Field of Classification Search
CPC ... A62C 3/0271; A62C 3/0292; A62C 25/005; A62C 27/00; A62C 31/28
See application file for complete search history.

(56) References Cited

U.S. PATENT DOCUMENTS

| | | | | |
|---|---|---|---|---|
| 5,419,497 | A * | 5/1995 | Warrington | A62C 25/00 137/355.12 |
| 2001/0042627 | A1* | 11/2001 | Carrier | A62C 5/02 169/24 |
| 2004/0118575 | A1* | 6/2004 | Hayes | A62C 27/00 169/52 |
| 2011/0094761 | A1* | 4/2011 | Bollens | A62C 27/00 169/52 |
| 2011/0266009 | A1* | 11/2011 | Liu | A62C 27/00 169/52 |
| 2017/0016448 | A1* | 1/2017 | Younker | F04D 13/021 |

* cited by examiner

*Primary Examiner* — Ryan A Reis
(74) *Attorney, Agent, or Firm* — Buchalter; Cecily Anne O'Regan

(57) ABSTRACT

Aspects of the disclosure include providing additional sources of water, and additional means for delivering the additional water, as needed in a fire emergency. A system in accordance with an aspect of the present disclosure provides pumping means, conduit for delivering water from a local source to the pump, and conduit for delivering the water as needed to fight a fire.

10 Claims, 5 Drawing Sheets

AUXILIARY FIRE DEFENSE SYSTEM

CROSS REFERENCE TO RELATED APPLICATIONS

The present application claims the benefit under 35 U.S.C. § 119(e) of U.S. Patent Application No. 62/818,671, filed on 14 Mar. 2019 and entitled "AUXILIARY FIRE DEFENSE SYSTEM," which application is incorporated by reference herein in its entirety.

BACKGROUND

Field

Aspects of the present disclosure generally relate to fire suppression, and more particularly to an auxiliary fire defense system.

Background

Large scale wildfires have become more common occurrences in the past several years. What was formerly considered an event that occurred once in every one hundred years now occurs approximately once every decade. In California alone during calendar year 2018, over fifty separate fires each burned more than 1000 acres; approximately one hundred people were killed. Billions of dollars of damages were incurred, and billions of dollars were spent fighting the fires. The entire western portion of the United States faces "fire season" every year in the summer months. In 2017, wildfires consumed areas the size of New Jersey, Connecticut, Delaware, and Rhode Island combined.

Some of the problems faced when fighting large fires is the lack of available resources. Providing manpower to fight multiple fires, when such fires are spread across a large geographical area, is logistically difficult. Equipment, such as fire engines, aerial support tankers, fire retardant sprayers, etc., are in short supply and must be shared. Water supplies are also difficult to manage, as pressure in the supply system must be shared by the various firefighting agencies, and may not be readily available where the fire is located at.

SUMMARY

Aspects of the disclosure include providing additional sources of water, and additional means for delivering the additional water, as needed in a fire emergency. A system in accordance with an aspect of the present disclosure provides pumping means, conduit for delivering water from a local source to the pump, and conduit for delivering the water as needed to fight a fire.

An apparatus in accordance with an aspect of the disclosure comprises a chassis, a motor coupled to the chassis, a pump, coupled to the motor, an inlet conduit coupled to the pump, and an outlet conduit coupled to the pump, in which the apparatus is configured to deliver water from a water source on a property for fire suppression.

Such an apparatus further optionally comprises the water source being a swimming pool, the motor being a gasoline-powered motor, and the outlet conduit comprising a valve. Such an apparatus may also further comprise a beacon for indicating the presence of the apparatus at a property, and the apparatus being configured to match the property where the water source is located.

A method of fire suppression in accordance with an aspect of the present disclosure comprises assessing a property comprising a water source, installing a system configured to match the property comprising the water source, maintaining the system, and operating the system when a fire incident occurs.

Such a method further optionally includes the system comprising a chassis, a motor coupled to the chassis, a pump, coupled to the motor, an inlet conduit coupled to the pump, and an outlet conduit coupled to the pump, in which the system is configured to deliver water from the water source. The method may further comprise notifying a first responder about a location of the system, notifying the first responder through setting a beacon at the property, the motor being a gasoline-powered motor, and the water source being a swimming pool.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further purposes and advantages, will be better understood from the following description when considered in connection with the accompanying figures. It is to be expressly understood, however, that each of the figures is provided for the purposes of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

DETAILED DESCRIPTION

Figure 1:
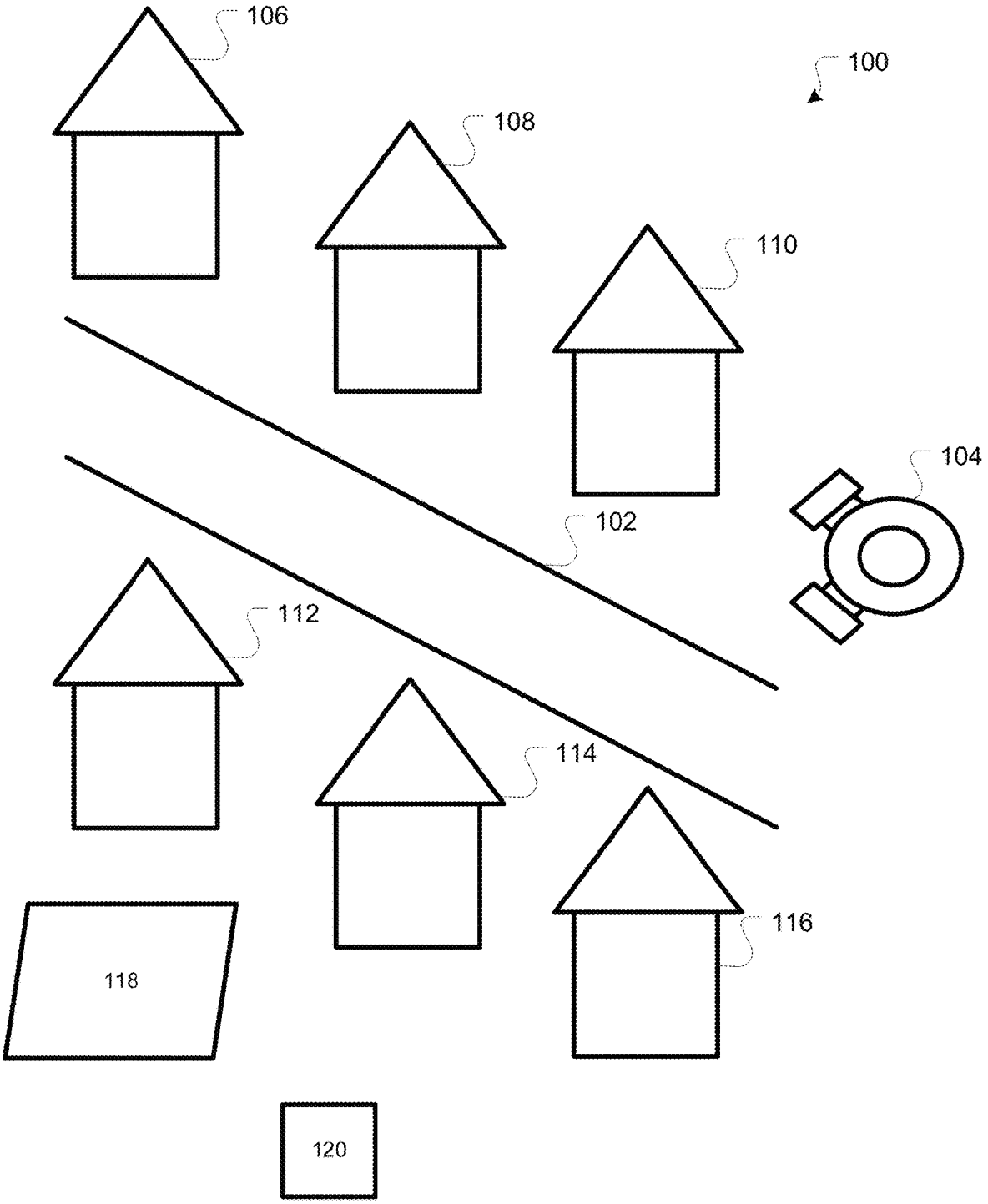
FIG. 1 illustrates an embodiment of a safety system in accordance with an aspect of the present disclosure.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

Overview

The present disclosure describes an auxiliary fire suppression system that can be used to support firefighting efforts. The system may provide homeowners, residents, and/or firefighters with additional resources to assist in fire suppression during a wildfire event.

In a wildfire event there are limited resources that are available for fighting the fire. In each case, fire professionals review the available fire-fighting materials/equipment, and the status of the fire in each location, to determine where best to deploy the resources. Part of this determination is a calculation involving whether a particular structure can be saved, the safety of the firefighters, and what resources are available at a given location. Further, in many wildfire events, the first responders are from divergent geographical locations, and thus unfamiliar with the neighborhoods where the fire is burning.

One of the most precious resources during a fire event is water. A fire engine carries approximately 500 gallons of water. The engine may use 400 gallons of this water to protect a home and reserve 100 gallons for crew safety. Thus, fire crews are often very prudent on water use, as 400 gallons may only be several minutes of water available to fight the fire. Although fire hydrants are available during emergencies, the demand for water at multiple hydrants may reduce the pressure and amount of water available at any given hydrant, and the hydrant may not be located where the water is most urgently needed. Home water systems, e.g., garden hoses connected to a house, tap water, etc., have very little pressure during a fire event, and do not provide enough volume of water to adequately extinguish larger fires. Further, fire events often disrupt electrical power delivery to houses, rendering electrically-powered water pumps effectively useless.

Houses with swimming pools are often on larger lots, and the pool may be too far away from the fire engine for the fire engine to access the pool water. Although fire engines have pumps that can pull water from water sources, a hose must be placed between the pool and the fire engine, and firefighters have no idea of whether a given house has a pool or not. The time it takes for firefighters to determine if the pool can be accessed and to install the hoses may reduce or eliminate the ability to use the available water. Although the fire department may have water available on their own equipment, knowing that a second water source is present may allow for different firefighting tactics to be applied in a given fire event.

FIG. 1 illustrates a scenario in accordance with an aspect of the present disclosure.

Neighborhood 100 comprises street 102, fire hydrant 104, and houses 106-116. During a fire event, firefighters may use hydrant 104 as a water source to suppress fire occurring near houses 106-116.

In a wildfire event, fire may be approaching neighborhood 100 from multiple directions, e.g., neighborhood 100 may be or near the point of convergence where multiple fires join together to become a single fire (also known as a "complex" fire, e.g., the Mendocino Complex fire in Northern California in 2018). With only a single water source, i.e., hydrant 104, it may be difficult to fight fire that threatens houses 106-110 while fighting a separate fire threatening other houses, e.g., house 114. Even if a fire engine (not shown) is able to deliver water from the engine tanks, the available water to protect houses 106-116 is limited.

House 114 is shown as having a water source 118, e.g., swimming pool, koi pond, etc. and an auxiliary fire suppression system 120. The homeowner/resident of house 114, and/or firefighters may use water source 118 and system 120 to protect house 114 while hydrant 104 is being used to protect houses 106-110.

Hardware Environment

Figure 2:
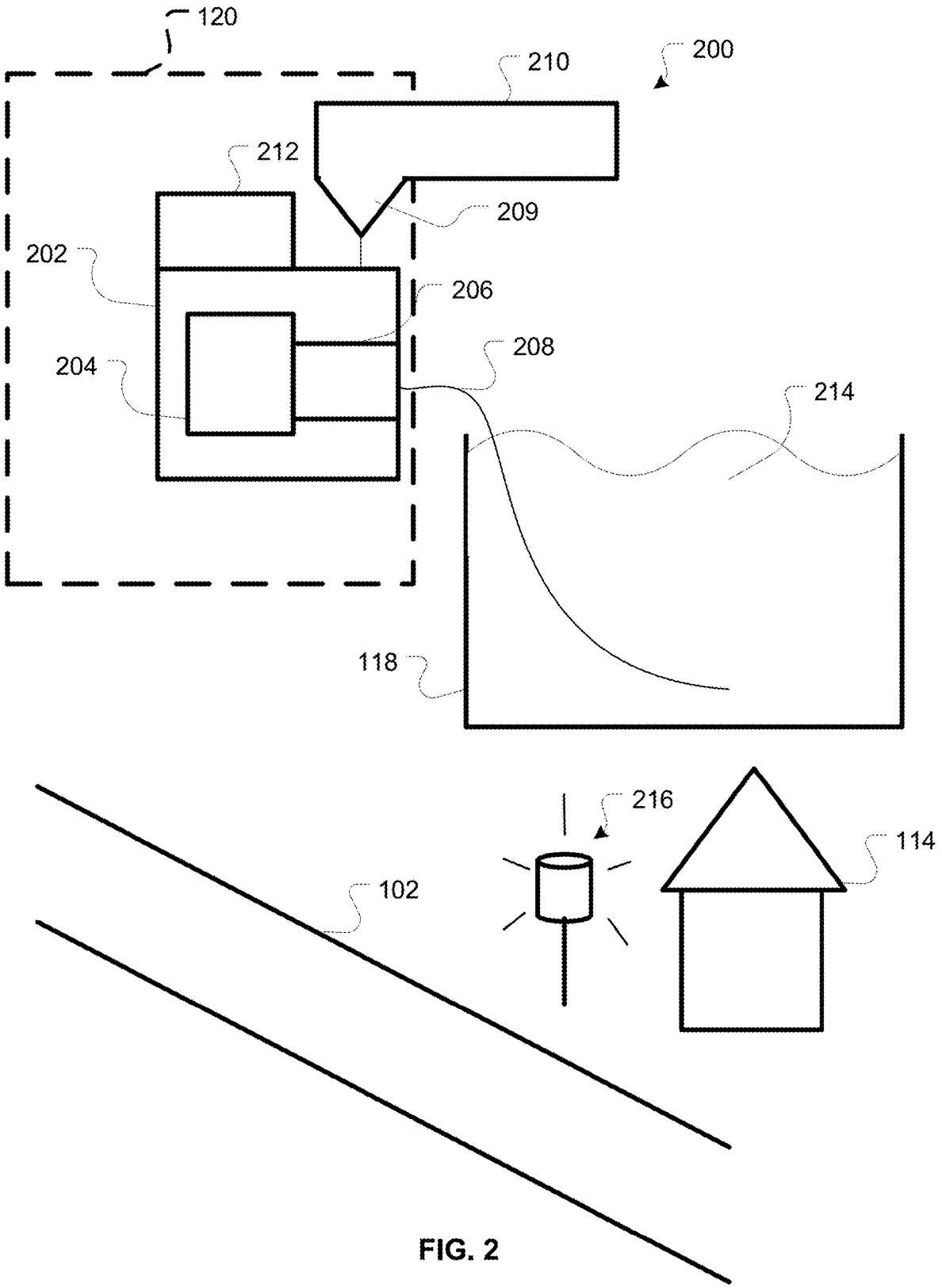
FIG. 2 is a block diagram that illustrates a hardware environment in accordance with an aspect of the present disclosure.

FIG. 2 is a diagram of a fire suppression system in an aspect of the present disclosure.

System 200 comprises water source 118 and system 120. System 120 comprises carriage 202, motor 204, pump 206, inlet hose 208, outlet valve 209, outlet hose(s) 210, and container 212.

Carriage 202 may be a uniform mounting frame and/or chassis for mounting various components of system 200. Carriage 202 may be of such a design that maintenance of system 120 is made easier. For example, and not by way of limitation, one particular system 120 at house 114 may be interchanged with another system 120 during periods of maintenance, etc., such that house 114 may have a system 120 present at all times. A substantially uniform carriage 202 may allow for interchangeability of entire systems 120 at various houses 114, or may allow for interchangeability of components within system 120, as desired.

Motor 204 may be a power source for pump 206. Motor 204 may be a gasoline powered motor, e.g., a Honda GX270 Series engine, but may be other engines without departing from the scope of the present disclosure. Although described as a gasoline-powered engine, motor 204 may be natural gas powered, electrically powered, etc., without departing from the scope of the present disclosure. Motor 204 may be coupled directly to pump 206, in that the crankshaft of motor 204 may be coupled to the impeller of pump 206; however, motor 204 may be coupled to pump 206 in other ways without departing from the scope of the present disclosure.

Pump 206 may be a single-stage centrifugal impeller-type pump, however, two-stage and/or multi-stage impeller pumps, internal gear pumps, piston pumps, diaphragm pumps, rotary, linear, and/or reciprocating type positive displacement pumps, etc., may be used without departing from the scope of the present disclosure. Pump 206 and motor 204 may be an integrated unit, e.g., such as NorthStar item number 106471, but can also be separate units that are combined during manufacturing of system 120.

Inlet hose 208 may be a standard-type garden hose. However, inlet hose may need to allow for a large volume of fluid 214 (e.g., water from water source 118) to be transferred to outlet hose 210 via pump 206, and thus may need to have a larger diameter and/or have a greater resistance to collapsing and/or kinking than a standard-type garden hose. As such, hoses having a larger diameter, larger vacuum rating, and/or stiffer wall material compositions may be employed without departing from the scope of the present disclosure. For example, and not by way of limitation, a three-inch inlet hose 208, having an aluminum/polyvinyl chloride (Al/PVC) reinforced hose wall, may be used to reduce the possibility of inlet hose 208 becoming disabled when in use. Other diameters, e.g., 1.5 inches, 2 inches, etc. may also be used without departing from the scope of the present disclosure.

Outlet valve 209 may allow for multiple outlet hoses 210 to be connected to system 120. For example, and not by way of limitation, a "wye" valve may be attached to the outlet of pump 206. The wye valve may allow for one or more of the outlets to be disabled, i.e., from not delivering fluid through the outlet valve 209, in which case the valve may be known as a "gated wye" valve. In an aspect of the present disclosure, additional gated wye valves can be added to outlet valve 209, or to one or more of outlet hoses 210, to provide additional connections to system 120 for additional outlet hoses 210.

Outlet hose 210 may also be a standard-type garden hose; however, as with inlet hose 208, pump 206 may deliver a larger amount of fluid 214 than a standard-type garden hose can deliver without failing (e.g., rupturing). As such, outlet hose 210 may also have a larger diameter, higher vacuum rating, and/or stiffer wall construction than a standard-type garden hose, such that outlet hose 210 can withstand the volume and pressure of fluid 214 being delivered by pump 206.

Inlet hose 208 and outlet hose 210 may have standard couplings to allow for interchangeability for the hoses 208 and 210 with any pump 206. For example, and not by way of limitation, inlet hose 208 and outlet hose 210 may have National Pipe Thread (NPT) standardized threads, e.g., a taper rate of 1 inch of diameter in 16 inches of length at an off-center angle of 1.7899 degrees, but other connections may be used without departing from the scope of the present disclosure. Further, the connectors that couple inlet hose 208 and outlet hose 210 to pump 206 may differ, the colors of inlet hose 208 and outlet hose 210 may be different, etc., such that in a fire event, it will be easy to determine which hose couples to which port on pump 206 and in what orientation.

Container 212 may contain accessories/specialty items that may be employed with system 200. For example, and not by way of limitation, inlet hose 208 and outlet hose 210 may be stored in container 212, such that inlet hose 208 and outlet hose 210 are not deleteriously affected by exposure to sunlight, weather conditions, dirt, etc., and/or are readily accessible should system 200 be placed into service. Container 212 may also contain hose nozzles, filters, etc., that can be coupled to inlet hose 208/outlet hose 210 to make operation of system 200 more reliable.

Container 212 may also hold beacon 216. Beacon 216 may be a flashing/specialty light, which may be battery powered, that may act as an indicator to firefighters that a system 120 is present. In a fire event, container 212 may be opened and beacon 216 placed in front of house 114 (or wherever system 120 is located) such that firefighters are aware that a system 120 is available to them. Additional information related to beacon 216 may include location information that has been pre-delivered to firefighting agencies such that firefighting agencies have the location of systems 120 before the fire event occurs; beacon 216 may act, in such cases, as a confirmation to firefighters that system 120 is present and ready for use should firefighters need such system(s) 120. Other information that may be included with beacon 216 is information that may be useful to first responders upon arrival at a fire event, e.g., location of system 120, number of outlet hoses 210 available, length of outlet hoses 210 attached, amount of water in water source 118, etc.

The presence of system 120 may be used as an additional asset for first responders since first responders may not need to remove hoses from the fire engine, utilize the limited fire engine stored water supply, etc., to fight a fire in a given location. Further, knowing that some hoses, e.g., outlet hoses 210 are already in place, first responders may be able to connect their own hoses to system 120 and fight fires at a greater distance from the water source.

Installation of Auxiliary System

Figure 3:
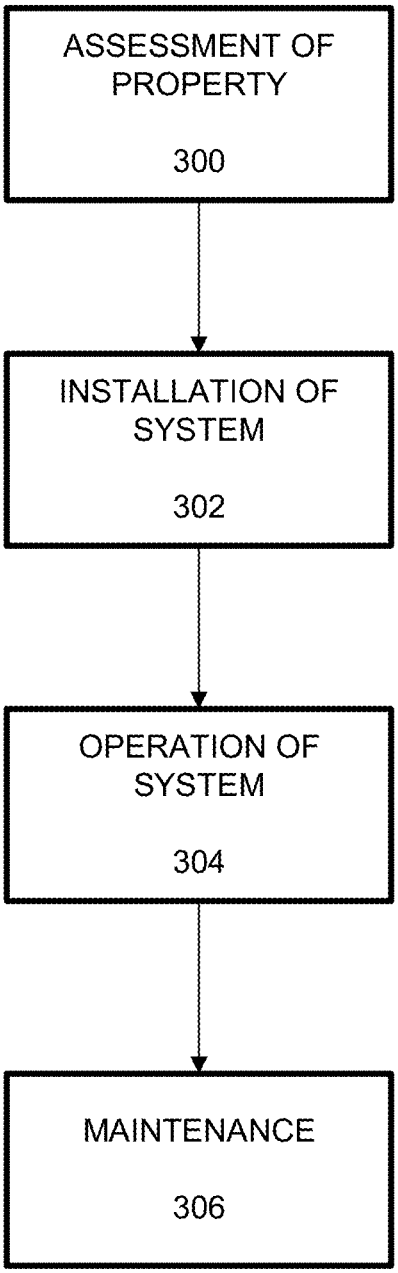
FIG. 3 is a block diagram that illustrates a platform in accordance with an aspect of the present disclosure.
Figure 4:
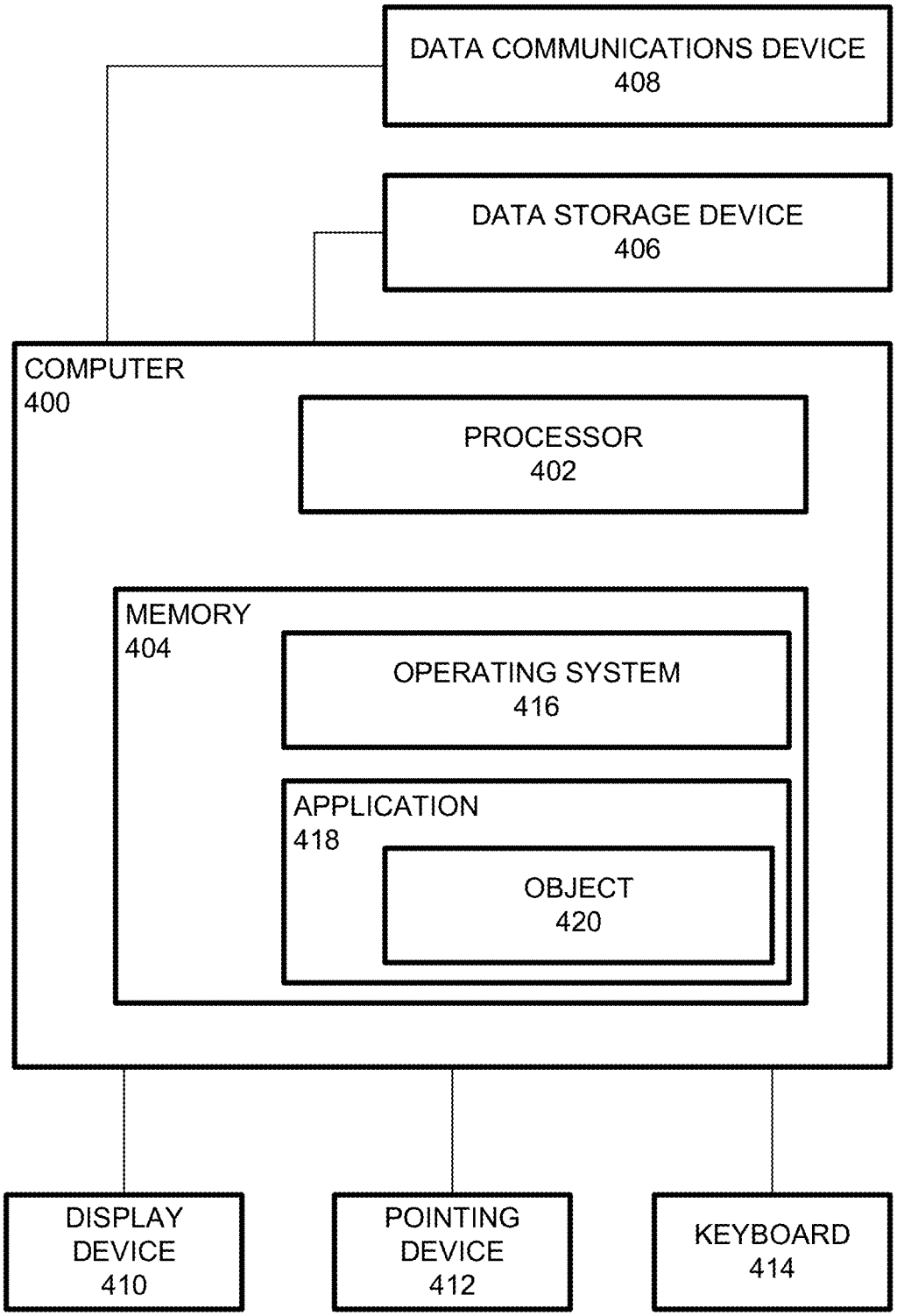
FIG. 4 is a block diagram that illustrates a safety method in accordance with an aspect of the present disclosure.

FIG. 3 illustrates an installation of a system in accordance with an aspect of the present disclosure. (rental approach, operation, assessment prior to installation, etc.).

Block 300 illustrates an assessment of a given property to determine what, if any, additional protection may be provided through the installation of one or more systems 120. Such an assessment may include recommendations to the property owner/occupant regarding fire safety, e.g., brush clearance, possible emergency escape routes, etc. Further, such an assessment may include the recommendations for placement of the system(s) 120 at a given residence.

Assessment may also include Computer-Aided Drawing (CAD) plans and/or other documents showing how system 120 may be available to the fire department, reference materials for education of the home owner/resident, and/or other materials.

Block 302 illustrates installation of one or more systems 120 at a given residence. Installation of a system 120 may include an instructional walk-through for the property owner/resident such that proper operation may be enabled in the case of an emergency. For example, and not by way of limitation, a representative, who may be trained in firefighting, may instruct the property owner/resident on how to start the system, where to put the hoses 208 and 210, where to place beacon 216, how to energize beacon 216, etc., such that either the property owner/resident can operate system 120, or that first responders may know the location and placement of system 120 when an emergency occurs.

Block 304 illustrates operation of system 120. Operation may include the initial setup of system 120, e.g., laying out hoses 208 and 210, starting motor 204, etc., as well as pumping water 214 from source 118.

Block 306 illustrates maintenance of system 120. Maintenance may include periodic checks of system 120 performed either by home owner/resident or by professionals trained in maintaining such systems 120. For example, and not by way of limitation, motor 204 may be a gasoline engine, and gasoline stored in system 120 may degrade over time. Any degraded gasoline would need to be removed from system 120 and replaced with gasoline that would properly run motor 204 in the event of an emergency. Home owners/residents may not be equipped to properly remove and/or dispose of gasoline, and, as such, professionals may be employed to perform such tasks.

Maintenance may also include a check of system 120, to ensure that system 120 has not been tampered with, that all parts of system 120 installed at a given location are present and properly located, that instructions are properly included and legible, etc.

Although the presence of system 120 at a given residence may encourage a particular resident to remain in an evacuation area to protect the residence, system 120 does not provide, and is illustrated to the resident as not providing, adequate safety precautions to survive any given emergency. System 120 representatives would, during assessment and/or installation, as well as during maintenance visits, encourage home owners/residents to follow evacuation orders when requested by the proper authorities. However, should a home owner/resident be unable to evacuate, e.g., because the fire approached too rapidly for a proper evacuation, the home owner/resident may be provided with proper instruction on the use of system 120 such that they can properly use system 120 in an emergency.

Fire departments may be given information as to the location of systems 120 within their jurisdiction. As such, the presence of beacon 216, and/or other information available to local fire departments, may also indicate to first responders the presence of system 120 at a given residence.

The present disclosure may be implemented using a computer 400, which generally includes, inter alia, a processor 402, random access memory (RAM) 404, data storage devices 406 (e.g., hard, floppy, and/or CD-ROM disk drives, etc.), data communications devices 408 (e.g., modems, network interfaces, etc.), monitor 410 (e.g., CRT, LCD display, etc.), mouse pointing device 412 and keyboard 414. It is envisioned that attached to the computer 400 may be other devices such as read only memory (ROM), a video card, bus interface, printers, etc. Those skilled in the art will recognize that any combination of the above components, or any number of different components, peripherals, and other devices, may be used with the computer 400.

The computer 400 usually operates under the control of an operating system 416. The present invention may be implemented in one or more application programs 418 that operate under the control of the operating system 416. The application program 418 may be a location-based program. In an embodiment of the present disclosure, the application program 418 provides one or more objects 420.

Generally, the application program 418 and objects 420 comprise instructions and/or data that are embodied in or retrievable from a computer-readable device, medium, or carrier, e.g., the data storage device 406, a remote device coupled to the computer 400 via the data communications device 408, etc. Moreover, these instructions and/or data, when read, executed, and/or interpreted by the computer 400 cause the computer 400 to perform the steps necessary to implement and/or use the present disclosure.

Thus, the present invention may be implemented as a method, apparatus, or article of manufacture using standard programming and/or engineering techniques to produce software, firmware, hardware, or any combination thereof. The term "article of manufacture" (or alternatively, "computer program product") as used herein is intended to encompass a computer program accessible from any computer-readable device, carrier, or media. Of course, those skilled in the art will recognize many modifications may be made to this configuration without departing from the scope of the present disclosure.

Computer 400 may be a personal computer, or may be a hand-held device such as a smart phone, cellular telephone, tablet, etc. Computer 400 may have the ability to geolocate using Global Positioning System (GPS) satellite data, Graphical Information System (GIS) data, and/or other positioning systems and/or data.

Figure 5:
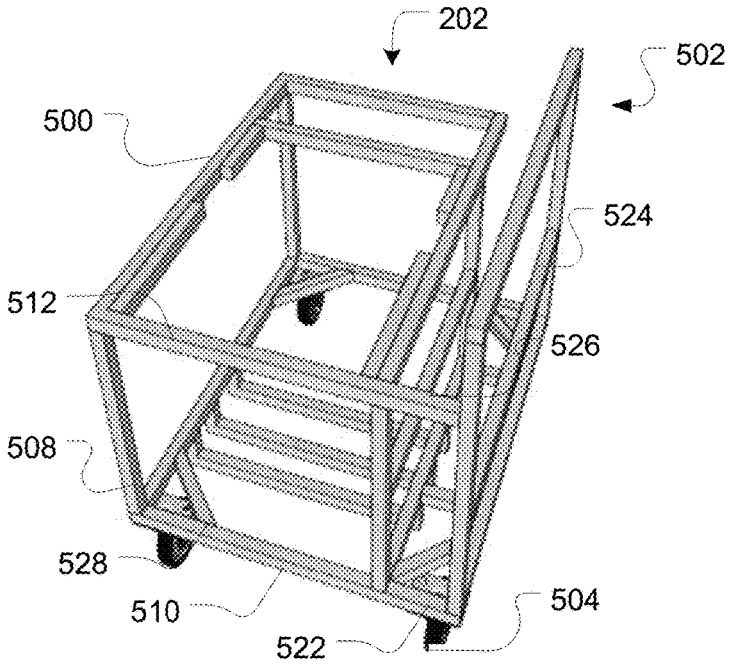
FIGS. 5 and 6 illustrate a carriage in accordance with one or more aspects of the present disclosure.
Figure 6:
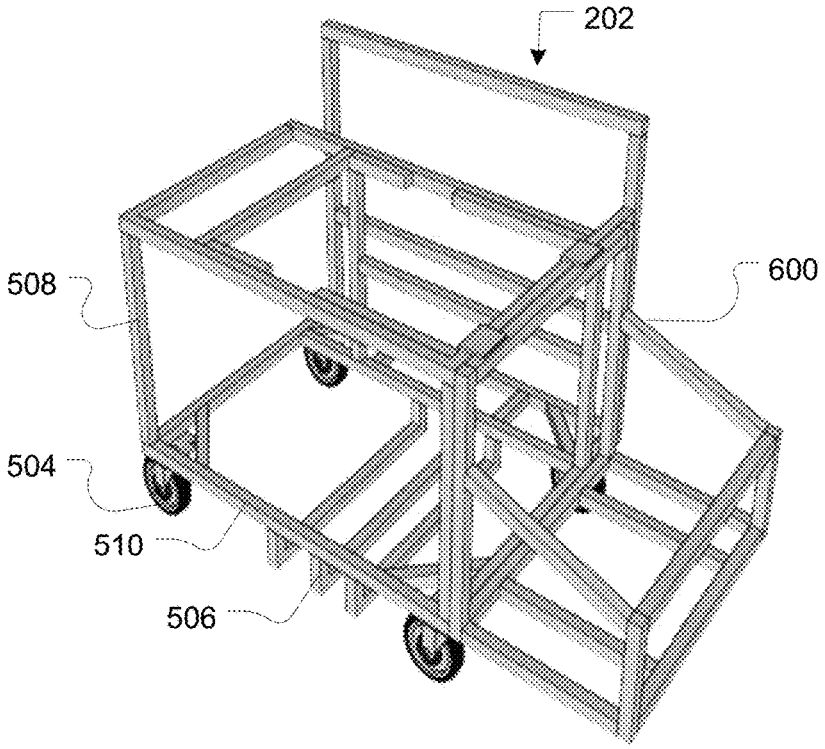

FIGS. 5 and 6 illustrate a carriage in accordance with one or more aspects of the present disclosure.

FIG. 5 illustrates a carriage 202 in accordance with an aspect of the present disclosure. Carriage 202 may be made from steel, aluminum, and/or other materials, and may be designed to hold motor 204 and pump 206 in chassis 500, inlet hose 208 and/or outlet hose(s) 210 in channel 502, container 212 above chassis 500, and may include wheels 504 to make system 120 easier to maneuver. Other configurations of carriage 202 are possible without departing from the scope of the present disclosure. The chassis 500 has a carriage frame lower support structure 510 with four corners, three U-shaped horizontal members 506 and four vertical side frame members 508 extending from each of the four corners of the carriage frame lower support structure 510. A strengthening support member 528 can be provided at each corner connecting two adjacent members of the lower support structure. Upper chassis horizontal frame members 512 are provided that connect the vertical side frame members 508 at an upper surface forming an upper opening of the carriage 202. The carriage frame lower support structure 510, vertical side members 508 and upper horizontal frame members 512 outline container 212. Extending on one side of the chassis 500 from the carriage frame lower support structure 510 is a channel 502. The channel 502 includes a channel base structure 522, which extends from the carriage frame lower support structure 510, and a vertical channel frame member 524 positioned on a side of the channel base structure 522 opposite the carriage frame lower support structure 510. The vertical channel frame member 524 comprising two vertical channel side frame members and a horizontal upper channel frame member. An upper perpendicular horizontal channel frame member 526 extends from an upper chassis horizontal frame member 512 to perpendicularly engage the vertical channel frame member 524.

FIG. 6 illustrates a carriage 202 with an attached rack 600. Rack 600 may be used to store other equipment that may be used in conjunction with system 120, e.g., additional outlet hoses 210, an enclosure that may be more heat resistant than the remainder of carriage 202 to store fuel for motor 204, additional inlet hose 202 and/or outlet hose 210 fittings, etc. Other configurations of carriage 202 with one or more racks 600 attached to various points on carriage 202 are possible without departing from the scope of the present disclosure.

Those skilled in the art will recognize that any combination of the above components, or any number of different components, including computer programs, peripherals, and other devices, may be used to implement the present disclosure, so long as similar functions are performed thereby.

In the present disclosure, a processor, microprocessor, and/or computer may be employed in one or more aspects of the disclosure. The use of a processor, microprocessor, and/or computer in and of itself does not render such aspects of the present disclosure as being directed to a judicial exception to patent-eligible subject matter, i.e., a law of nature, a natural phenomenon, or an abstract idea without significantly more. Further, aspects of the present disclosure may claim patent-eligible applications of the concepts of laws of nature, natural phenomena, and abstract ideas.

For example, and not by way of limitation, the present disclosure is directed toward a patent-eligible concept. Aspects and embodiments of the present disclosure, when taken individually and as an ordered combination, are to be considered when determining whether the additional element(s) transform the nature of the claim.

The present application comprises something more than organizing human activity, either through the use of a processor, microprocessor, and/or computer, and/or otherwise, because the processor does not organize human activity; the processor in aspects of the present disclosure provides data to first responders, people within an emergency area, etc., such that a more informed choice of responding to the emergency can be achieved. Such a result has not been available prior to the present disclosure.

Even if the present disclosure may be directed to a patent-ineligible concept, the elements of the present disclosure, both individually and as an ordered combination, are to be considered to determine whether the additional elements transform the nature of the claim into a patent eligible application. The present disclosure comprises an inventive concept sufficient to ensure that the disclosure in practice amounts to significantly more than a patent upon an ineligible concept. Because the judicial exceptions to patent protection of abstract ideas must be construed carefully, applications of such concepts to a new and useful end remain eligible for patent protection within the present disclosure.

Even if in some instances the present disclosure describes concepts that may be directed to an abstract idea and/or another judicial exception, the present disclosure still describes patentable subject matter that remains eligible for patent protection. For example, and not by way of limitation, the present disclosure does not merely apply applicable laws that are well known in the related art.

Further, the present disclosure describes additional patent-eligible concepts such as a process designed to solve a technological problem in conventional industry practice, and a problem that the industries involved had not been able to obtain previously. Further, the present disclosure is not simply steps previously known and merely implemented on a computer, but feature improvements on an existing technological process. The present disclosure provides solutions and improvements on existing processes that were not previously available.

Because a computer, processor, and/or microprocessor can serve as a patent-eligible structure for a computer-implemented function when the claimed function is coextensive with the microprocessor itself, and a standard microprocessor can serve as sufficient structure for functions that can be achieved by any general purpose computer without special programming, the present invention provides such patent eligibility.

Although the present disclosure and its advantages have been described in detail, it should be understood that various changes, substitutions and alterations can be made herein without departing from the technology of the disclosure as defined by the appended claims. For example, relational terms, such as "above" and "below" are used with respect to a view of the device as shown in the present disclosure. Of course, if the device is inverted, above becomes below, and vice versa. Additionally, if oriented sideways, above and below may refer to sides of a device. Moreover, the scope of the present application is not intended to be limited to the particular configurations of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

Those of skill would further appreciate that the various illustrative logical blocks, modules, and algorithm steps described in connection with the disclosure herein may be implemented as various different types of materials and/or various different combinations of materials. To clearly illustrate this interchangeability, various illustrative components, blocks, modules, and steps have been described above generally in terms of their functionality. The various materials and/or combinations of materials employed to implement the present disclosure depends upon the particular application and design constraints imposed on the overall system. Skilled artisans may implement the described functionality in varying ways for each particular application, but such implementation decisions should not be interpreted as causing a departure from the scope of the present disclosure.

The description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

Although several embodiments have been described in detail for purposes of illustration, various modifications may be made without departing from the scope and spirit of the present disclosure. Accordingly, the disclosure is not to be limited by the examples presented herein, but is envisioned as encompassing the scope described in the appended claims and the full range of equivalents of the appended claims.

What is claimed is:

1. An apparatus, comprising:

a motor;

a pump, coupled to the motor;

an inlet hose coupled to the pump;

an outlet hose coupled to the pump; and a tankless carriage frame defining an interior space having a carriage frame lower support, four side frame members, a channel frame, and a channel lower support extending from the carriage frame lower support, wherein the channel frame extends perpendicularly from the channel lower support and parallel to a side frame member of the tankless carriage frame further wherein the tankless carriage frame is configured to hold the motor and pump within the interior space and the channel frame has a planar dimension on one side larger than an adjacent frame member and further wherein the channel frame is configured to secure the inlet hose or the outlet hose adjacent the carriage frame, wherein the apparatus is configured to deliver water from a water source on a property directly through the inlet hose to the outlet hose via the pump for fire suppression.

2. The apparatus of claim 1, in which the water source is a swimming pool.

3. The apparatus of claim 2, in which the motor is a gasoline-powered motor.

4. The apparatus of claim 3, further comprising a beacon for indicating a presence of the apparatus at a property.

5. The apparatus of claim 4, in which the outlet hose comprises a valve.

6. A method of fire suppression, comprising:

assessing a property comprising a water source;

installing a system wherein the system includes an apparatus, comprising a motor, a pump, coupled to the motor, an inlet hose coupled to the pump, and an outlet hose coupled to the pump, and a tankless carriage frame defining an interior space having a carriage frame lower support, four side frame members, a channel frame, and a channel lower support extending from the carriage frame lower support, wherein the channel frame extends perpendicularly from the channel frame lower support and parallel to a side frame member of the tankless carriage frame wherein the tankless carriage frame is configured to hold the motor and pump within the interior space and the channel frame has a planar dimension on one side larger than an adjacent frame member and further wherein the channel is configured to secure the inlet hose or the outlet hose adjacent the carriage frame, wherein the apparatus is configured to deliver water from the water source on the property directly through the inlet hose to the outlet hose via the pump for fire suppression;

maintaining the system; and operating the system when a fire incident occurs.

7. The method of claim 6, further comprising notifying a first responder about a location of the system.

8. The method of claim 7, in which notifying the first responder comprises setting a beacon at the property.

9. The method of claim 8, in which the motor is a gasoline-powered motor.

10. The method of claim 9, in which the water source is a swimming pool.

* * * * *